US006393989B1

(12) United States Patent
Weimer

(10) Patent No.: US 6,393,989 B1
(45) Date of Patent: May 28, 2002

(54) DRONE OR TOWED BODY HAVING INFRARED FLARES FOR STIMULATING A FLYING TARGET

(75) Inventor: Peter Weimer, Markdorf (DE)

(73) Assignee: Dornier GmbH, Friedrichshafen (DE)

( * ) Notice: Subject to any disclaimer, the term of this patent is extended or adjusted under 35 U.S.C. 154(b) by 0 days.

(21) Appl. No.: 09/285,468

(22) Filed: Apr. 2, 1999

(30) Foreign Application Priority Data

Apr. 3, 1998 (DE) ..... 198 14 936

(51) Int. Cl.[7] ..... F42B 4/26; F42B 15/04; B64D 1/04

(52) U.S. Cl. ..... 102/336; 102/342; 102/355; 89/1.13; 89/1.34; 244/3.12

(58) Field of Search ..... 102/336, 342, 102/355; 244/3.12; 89/1.13, 1.34

(56) References Cited

U.S. PATENT DOCUMENTS

| | | | | |
|---|---|---|---|---|
| 3,135,511 A | | 6/1964 | Norman | 273/105.3 |
| 3,458,197 A | | 7/1969 | Woodward | 273/105.3 |
| 5,058,969 A | * | 10/1991 | Peterson et al. | 244/3.12 X |
| 5,852,254 A | * | 12/1998 | Wardecki et al. | 102/336 X |
| 6,055,909 A | * | 5/2000 | Sweeny | 102/336 |

FOREIGN PATENT DOCUMENTS

| | | |
|---|---|---|
| DE | 28 16 439 C2 | 4/1985 |
| DE | G 84 01 068.1 | 10/1987 |
| DE | 4116302 A1 | 11/1992 |

* cited by examiner

*Primary Examiner*—Peter A. Nelson
(74) *Attorney, Agent, or Firm*—Crowell & Moring LLP

(57) ABSTRACT

In a towed body with infrared flares located at its rear, the flares are in an ejection unit and are pulled out of the towed body via a tow cable as they ignite, preventing the towed body from being destroyed by missiles when it is used during target simulation.

8 Claims, 5 Drawing Sheets

DRONE OR TOWED BODY HAVING INFRARED FLARES FOR STIMULATING A FLYING TARGET

BACKGROUND AND SUMMARY OF THE INVENTION

This application claims the priority of German application No. 198 14 936.0, filed Apr. 3, 1998, the disclosure of which is expressly incorporated by reference herein.

The invention relates to a drone or a towed body having infrared flares for simulating a flying target.

In manned flying target simulation, towed bodies have for some time been equipped with infrared burners (IR flares) and used for training and bombardment by missiles equipped with homing heads. These IR flares are available on the market for a broad spectrum of uses, and in this instance are permanently attached to the rear area of target drones or towed bodies. The IR flares, which are ignited by means of telemetry and commercial pyrotechnic igniters shortly before bombardment by missiles, simulate to the homing head of the missile, for a limited period of time, the hot gas stream of an operating aircraft engine. Since the probability of a hit by these missiles is very high, even without a warhead the target-simulating means (drone or towed body) is usually lost.

The object of the invention is to ensure the reusability of a towed body or drone when a flare which it carries is struck by a missile.

This and other objects and advantages are achieved by the towed body according to the invention, in which the flare is contained in an ejection unit and is pulled by a tow cable. The flare can be unwound during the time that it is burning, so that it burns up at a safe distance (approximately 8 meters, for example from the towed body. Thus, even in the event of a direct hit on the flare by the missile, the towed body can be reused. A reef line cutter cuts the tow cable after the fare burns out.

Other objects, advantages and novel features of the present invention will become apparent from the following detailed description of the invention when considered in conjunction with the accompanying drawings.

DETAILED DESCRIPTION OF THE DRAWINGS

Figure 1:
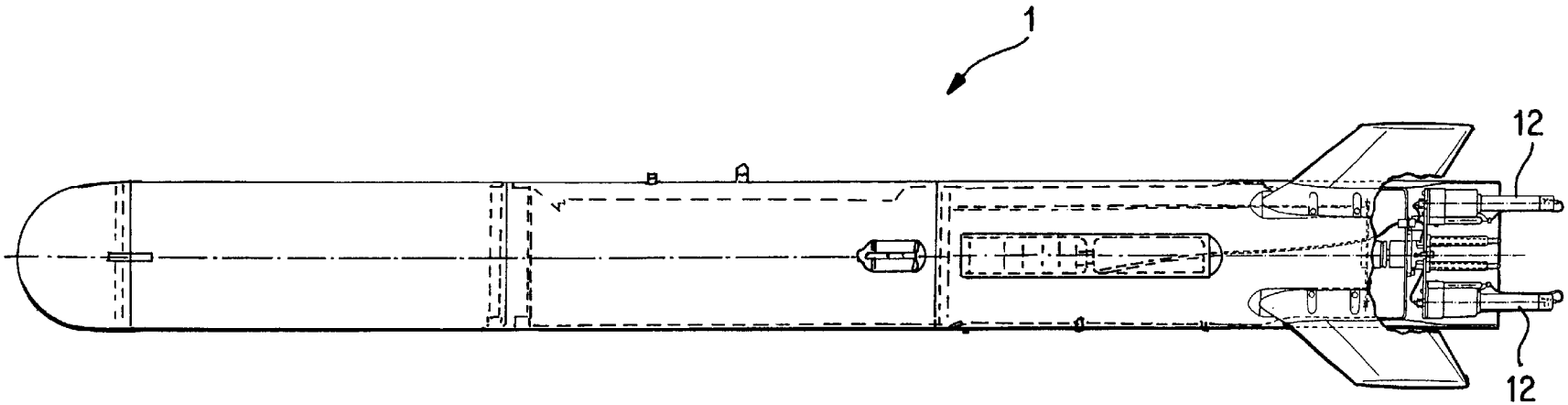
FIG. 1 is an overall view of the towed body having flares located at its rear.
Figure 2:
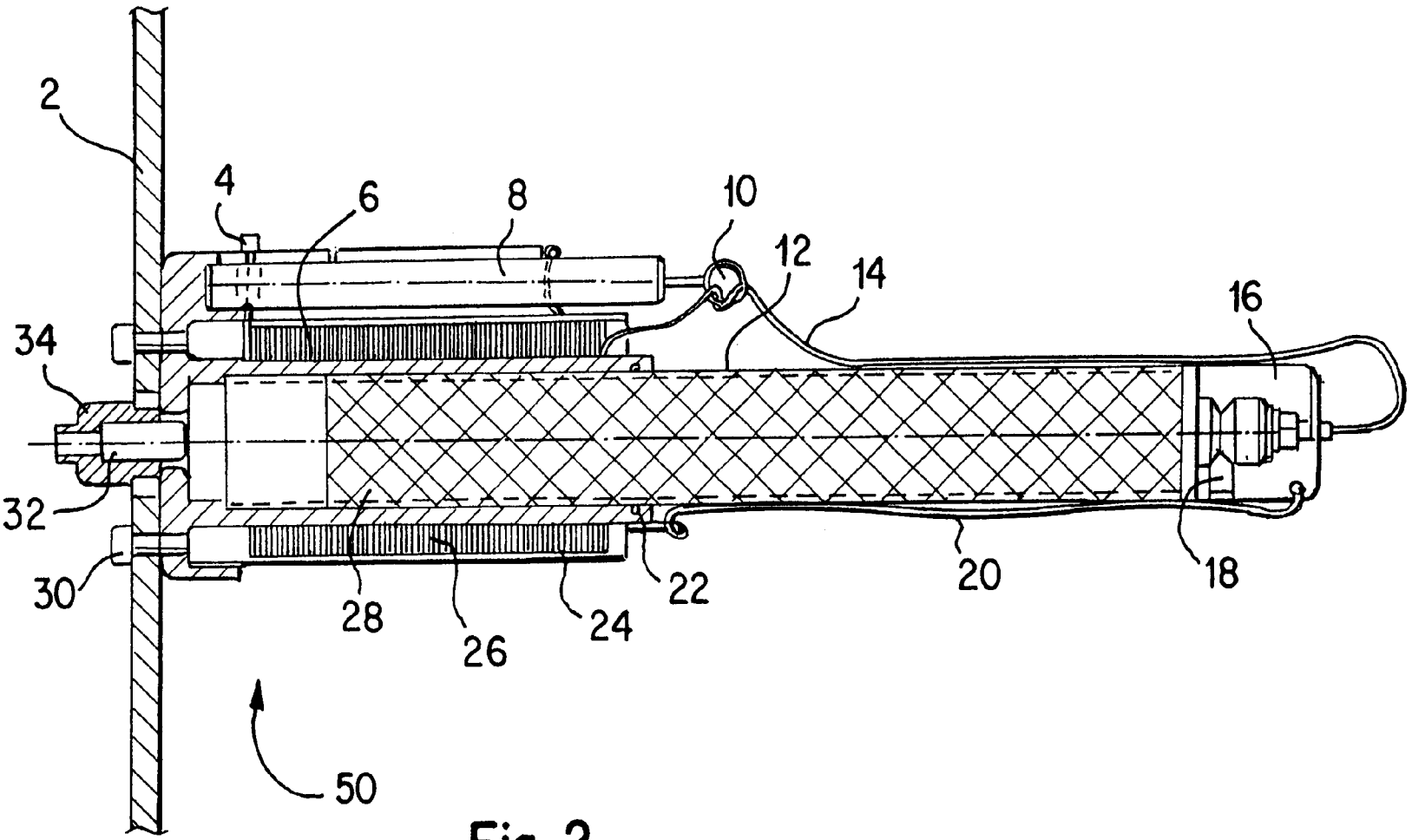
FIG. 2 is a sectional view of a flare ejection unit according to the invention.

FIG. 1 shows a towed body 1 with IR flares 12 at its rear. According to the invention, these infrared flares are ejected after being ignited. FIG. 2 shows an ejection unit 50 which serves for this purpose. An IR flare 12 (a standard flare for use in a towed body) is rotated through 180 degrees and pushed into an ejection unit 6 until it meets the rear stop. This IR flare has an open fire tube without its standard igniters. A towing adapter 16 is attached to the mechanical fastening seam of the IR flare by means of stud screw 18, and is connected by the thin tow cable 14 and/or the winding body 26 at rear end 4, to ejection unit 6. Tow cable 14 is guided directly ahead of its connection 4 at the rear through a standard reef line cutter 8 which is activated by pin 10 with tow cable 14. (The exact sequence of all the functions is explained in greater detail below). The active charge 28 of the IR flare is arranged such that it is open to the ignition and ejection charge 32, which is screwed by means of a receptacle 34 (directly from the rear) into ejection unit 6. The entire ejection unit 6 is screwed to pyrotechnic baseplate 2 by screws 30. A total of 8 ejection units 50 (see FIGS. 3 and 4) is screwed to the pyrotechnic baseplate, so that several training approaches can be made.

The infrared flare ejection unit shown in FIG. 2 operates according to the following sequence of functions:

Following electrical triggering of the ignition and ejection charge 32 (controlled by telemetry) and lighting of the active charge 28 of the IR flare, the ejection charge 32 is ejected rearward opposite the direction of flight, by the gas pressure that develops in the flare insert 12 that is sealed off by O-ring 22 from ejection unit 6. (See FIG. 2.) During this process, safety wire 20 (provided for safety during transport) is torn free. At the same time, for the first few centimeters of travel, pin 10 of the reef line cutter 8 is pulled over tow cable 14.

Figure 5:
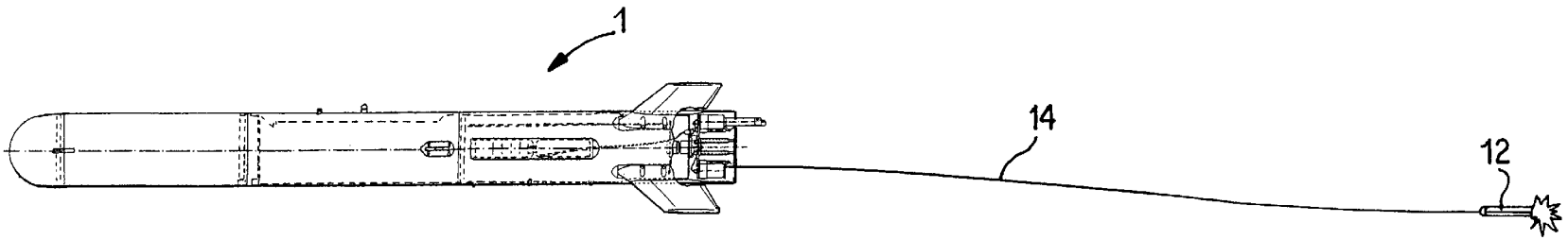
FIG. 5 shows a towed body with the flare ejected during the burning phase of the flare.

The internal winding 26 of the prefabricated tow cable winding 24 is pulled out completely for the specified towing length (approximately 8 meters). As soon as the tow cable 14 has been unwound and becomes taut, the flare insert rotates through 180 degrees so that the burning side now points rearward. (See FIG. 5.) After the flare burns out (about 40 seconds), the tow cable 14 is severed at the lower end at connecting point 4 (after a short time delay) by means of the reef line cutter 8 activated upon ejection. The burned-out flare insert 12 together with its tow cable 14 then flies away toward the rear, making room for another flare to be activated.

Since all further processes are forcibly coupled mechanically and pyrotechnically in ejection unit 6 (following ignition of the ejection charge 32), a very high level of protection against failure is achieved. If an ejection charge 32 fails, additional ejection units can easily be ignited since the flare insert 12 subject to the malfunction remains protected.

The entire ejection unit 50 (see FIG. 3) can be prepared for use as often as desired by inserting a new IR flare insert 12, tow cable winding 24, reef line cutter 8 and ignition and ejection charge 32.

Figure 3:
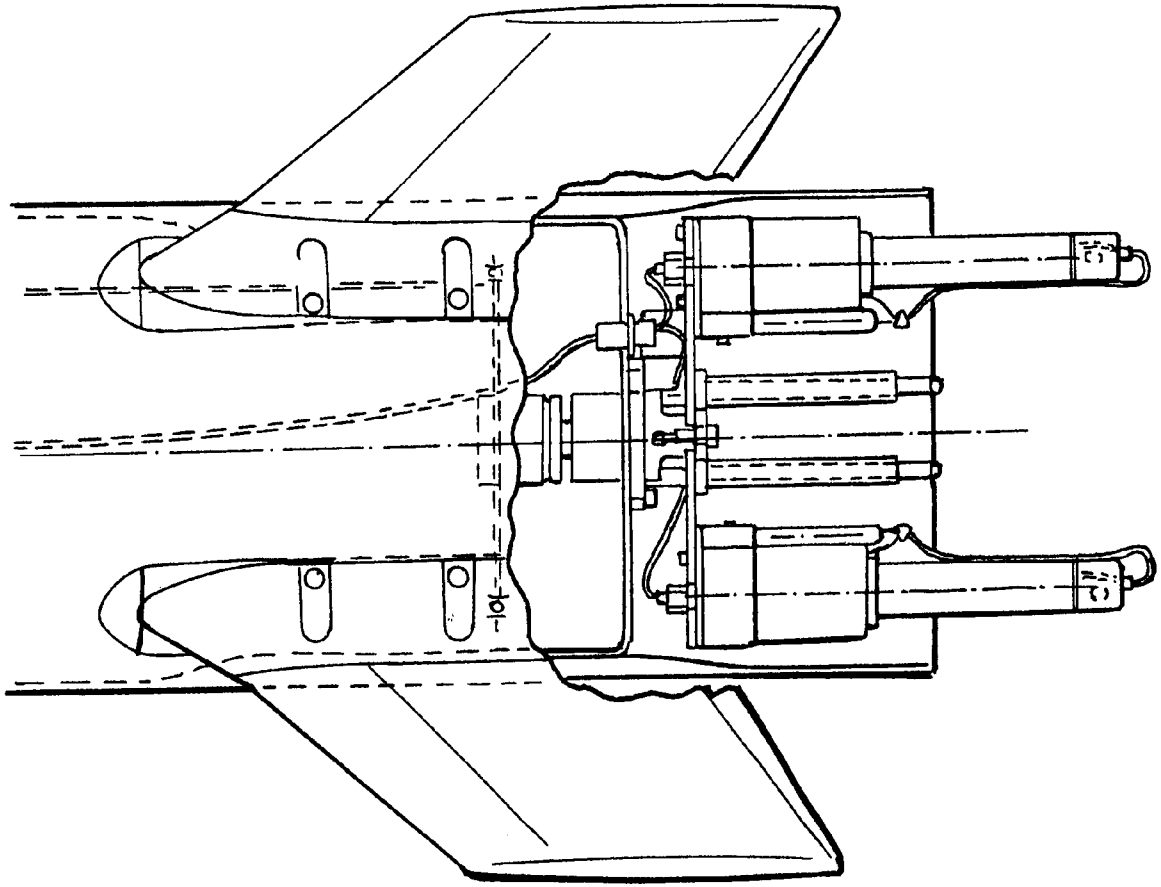
FIG. 3 is a pyrotechnic insert combined with an emergency ejection device.
Figure 4:
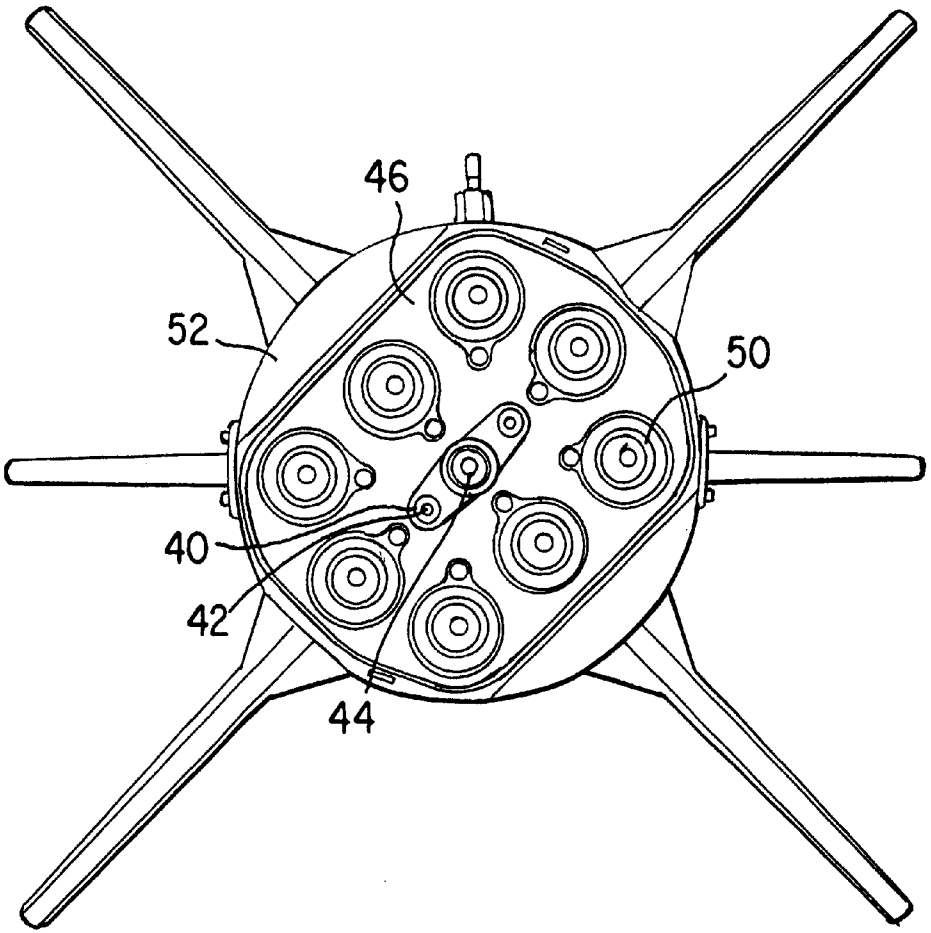
FIG. 4 is a rear view of the flare ejection unit shown in FIG. 2.

The function of the emergency ejection device shown in FIGS. 3 and 4 is as follows:

The pyrotechnic unit 46 with all of the ejection units 50 is connected through a magnetically triggerable coupling 48 by structural frame 36 to the towed body structure 52. If, as a result of a malfunction (of a reef line cutter, for example), it is impossible to eject a towed IR flare before recovering the towed body 52 at the towing aircraft, the entire pyrotechnic unit 46 can be discarded by releasing coupling 48. The electrical connection to the ignition and ejection charges 32 is released automatically by the separating plug interface 38. In order to permit a clean ejection, the entire pyrotechnic unit 46 is guided by guide tubes 40 and guide rods 42 fastened to structural frame 36.

For operation and storage in specially protected areas, the entire pyrotechnic unit 46 can be removed very quickly by means of central screw 44 (FIGS. 3 and 4) that is readily accessible from the rear without electrical circuits being activated (safety requirement).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A towed target, comprising:

a target body;

a flare carried on said target body;

an ejection unit mounted on the target body for holding said flare, said flare being ejected from said ejection unit when ignited;

a towing cable connected between the flare and the target body and adapted to be unwound when the flare is burning, whereby the flare is towed at a defined distance behind the towed target body; and means for cutting the towing cable after the flare is burned out.

2. A towed body for transporting a rearwardly located flare, comprising:

an ejection unit mounted on the towed body for holding a flare and ejecting it when it is ignited;

a towing cable connected between the flare and the towed body and adapted to be unwound when the flare is burning;

a reef line cutter for cutting the towing cable after the flare is burned out;

an ignition charge for igniting a flare in the ejection unit, whereby gas pressure develops inside the ejection unit, pushing the flare out of the ejection unit; and a safety wire which is torn free when the flare is pushed out of the ejection unit.

3. A towed body for transporting a rearwardly located flare, comprising:

an ejection unit mounted on the towed body for holding a flare and ejecting it when it is ignited;

a towing cable connected between the flare and the towed body and adapted to be unwound when the flare is burning; and a reef line cutter for cutting the towing cable after the flare is burned out; wherein, the tow cable is fastened to the flare by means of a stud screw;

when the flare is pushed out of ejection unit, the two cable actuates a pin of a reef line cutter, and an internal winding of the towing cable is pulled out completely; and the flare rotates through 180 degrees under the tension from two cable, whereby a burning end points backward.

4. A towed body for transporting a rearwardly located flare, comprising:

an ejection unit mounted on the towed body for holding a flare and ejecting it when it is ignited;

a towing cable connected between the flare and the towed body and adapted to be unwound when the flare is burning;

a reef line cutter for cutting the towing cable after the flare is burned out;

an ignition charge for igniting a flare in the ejection unit, whereby gas pressure develops inside the ejection unit, pushing the flare out of the ejection unit; and a safety wire which is torn free when the flare is pushed out of the ejection unit; wherein, the tow cable is fastened to the flare by means of a stud screw;

when the flare is pushed out of ejection unit, the tow cable actuates a pin of a reef line cutter, and an internal winding of the towing cable is pulled out completely; and the flare rotates through 180 degrees under the tension from tow cable, whereby a burning end points backward.

5. Towed body according to claim 1 further comprising a pyrotechnic unit for igniting the ejection units, said pyrotechnic unit being connected with towing body structure by means of a magnetically triggerable coupling in a structural frame.

6. A towed body for transporting a rearwardly located flare, comprising:

an ejection unit mounted on the towed body for holding a flare and ejecting it when it is ignited;

a towing cable connected between the flare and the towed body and adapted to be unwound when the flare is burning;

a reef line cutter for cutting the towing cable after the flare is burned out;

an ignition charge for igniting a flare in the ejection unit, whereby gas pressure develops inside the ejection unit, pushing the flare out of the ejection unit;

a safety wire which is torn free when the flare is pushed out of the ejection unit; and a pyrotechnic unit for igniting the ejection units, said pyrotechnic unit being connected with towing body structure by means of a magnetically triggerable coupling in a structural frame.

7. A towed body for transporting a rearwardly located flare, comprising:

an ejection unit mounted on the towed body for holding a flare and ejecting it when it is ignited;

a towing cable connected between the flare and the towed body and adapted to be unwound when the flare is burning; and a reef line cutter for cutting the towing cable after the flare is burned out; wherein, the tow cable is fastened to the flare by means of a stud screw;

when the flare is pushed out of ejection unit, the two cable actuates a pin of a reef line cutter, and an internal winding of the towing cable is pulled out completely; and the flare rotates through 180 degrees under the tension from two cable, whereby a burning end points backward;

and further comprising a pyrotechnic unit for igniting the ejection units, said pyrotechnic unit being connected with towing body structure by means of a magnetically triggerable coupling in a structural frame.

8. A towed body for transporting a rearwardly located flare, comprising:

an ejection unit mounted on the towed body for holding a flare and ejecting it when it is ignited;

a towing cable connected between the flare and the towed body and adapted to be unwound when the flare is burning;

a reef line cutter for cutting the towing cable after the flare is burned out;

an ignition charge for igniting a flare in the ejection unit, whereby gas pressure develops inside the ejection unit, pushing the flare out of the ejection unit; and a safety wire which is torn free when the flare is pushed out of the ejection unit; wherein, the tow cable is fastened to the flare by means of a stud screw;

when the flare is pushed out of ejection unit, the tow cable actuates a pin of a reef line cutter, and an internal winding of the towing cable is pulled out completely; and the flare rotates through 180 degrees under the tension from tow cable, whereby a burning end points backward;

and further comprising a pyrotechnic unit for igniting the ejection units, said pyrotechnic unit being connected with towing body structure by means of a magnetically triggerable coupling in a structural frame.

* * * * *